United States Patent [19]

Maki

[11] Patent Number: 4,676,169

[45] Date of Patent: Jun. 30, 1987

[54] SLUG ASSEMBLY FOR SHOTGUN SHOTSHELL

[76] Inventor: Nagatoshi Maki, 48-4, Kamiishihara 2-chome, Chofu-shi, Tokyo, Japan

[21] Appl. No.: 855,838

[22] Filed: Apr. 24, 1986

[30] Foreign Application Priority Data

Apr. 27, 1985 [JP] Japan ..... 60-89940

[51] Int. Cl.[4] ..... F42B 11/28

[52] U.S. Cl. ..... 102/439; 102/448; 102/501; 102/520

[58] Field of Search ..... 102/520–521, 102/448, 501, 439, 514

[56] References Cited

U.S. PATENT DOCUMENTS 2,306,140 12/1942 Reed ..... 102/522
2,996,992 8/1961 Critchfield et al. ..... 102/523
3,613,584 10/1971 Hendricks .
3,726,231 4/1973 Kelly et al. .
4,301,733 11/1981 Blanco ..... 102/501
4,517,898 5/1985 Davis et al. ..... 102/514

*Primary Examiner*—Harold J. Tudor
*Attorney, Agent, or Firm*—Merchant, Gould, Smith, Edell, Welter & Schmidt

[57] ABSTRACT

A slug assembly for a shotgun shotshell, having a slug which has a circular largest diameter portion, and which has at least one cylindroid portion consisting of inclined generatrices, a sleeve like spacer made of a plurality of split spacer elements coaxially surrounding the slug. The spacer has inner portions which come into close contact with the cylindroid portion of the slug. The slug assembly also has a disc like stabilizer between the wad and the slug, connected to the slug by means of male and female connectors. A front surface of the stabilizer comes into close contact with the rear end of the spacer.

4 Claims, 12 Drawing Figures

SLUG ASSEMBLY FOR SHOTGUN SHOTSHELL

BACKGROUND OF THE INVENTION

1. Field of the Invention

The present invention relates to a slug assembly for a shotgun shotshell.

2. Description of the Related Art

A slug load of a shotgun for animal hunting or target shooting usually comprises a case with a primer, a powder, an over-powder wad, a wad, and a slug. The powder, the over-powder wad, the wad, and the slug are inserted in the case in this order and the slug is held in the case by a crimp provided on the front open end of the case. This slug load has the following drawbacks.

(1) The grouping which represents a hit accuracy is worse than that of bullets of a rifle-gun. In addition, occasionally some of the slug mark(s) are deviated widely from the line of sight.

(2) Since the slug is usually made of lead and is naked, a large amount of lead becomes stuck to the inner surface of the barrel bore of the shotgun, and much time and labor is needed to remove the coating of lead. If slugs are fired from a barrel having a coating of lead, the grouping of the shotshells will be very bad.

(3) Since the slug load has a heavy slug and is fired at a high muzzle velocity, the user receives a heavy recoil. Thus, apart from animal hunting, in which the rate of fire is relatively small, a user tends to become easily fatigued, resulting in a decrease in the hit accuracy, particularly when practice shooting during or a shooting match at a stationary or moving target. In addition, the heavy recoil causes the users, particularly beginners to become gun-shy.

(4) Even though of the same gauge, shotguns have slightly different barrel bores, different barrel lengths, etc., dimensions and different choke shapes, depending on the manufacturer. To obtain a high score in a shooting match, the users must carefully select slugs which match the shotgun used. If well-matched slugs are not available on the market, the user must try to make good slugs, by themselves.

Regarding the problem of bad grouping, the outer diameter of the slug is generally smaller than the inner diameter of the barrel bore, and accordingly, when the slug is fired from the barrel, the slug may be inclined with respect to the axis of the barrel, or the slug may wobble when passing through the barrel bore. Furthermore, the rear portion of the slug is usually hollowed out so that the center of gravity of the slug is located toward the front of the slug, taken along the length thereof to provide a heavy head, and has a small tensile strength because of the lead or lead alloy of which the slug is made. Therefore, during the extremely rapid acceleration of the slug when the gun is fired, the slug may buckle at the hollowed out portion thereof, resulting in an asymmetrical deformation with respect to the axis of the slug. This worsens the grouping.

In addition to the foregoing, if the axis of the slug is inclined from the flight axis during the flight of the slug after leaving the muzzle of the gun, no effective stabilizing means is provided for restoring the posture of the slug.

SUMMARY OF THE INVENTION

The object of the present invention is therefore to provide a slug assembly for a shotgun shotshell which does not buckle when fired, can be fired from the muzzle while keeping a correct posture in which the slug is coaxial to the firing axis, has a stable posture during flight, will not deposit lead, of which the slug is made, on the inner surface of the barrel bore, and will match any barrel of the same gauge.

To achieve the above object, according to the present invention, there is provided a slug assembly for a shotgun shotshell having a case with a primer, a powder in the case, and a wad or wads in the case between the slug and the powder. The case is crimped at its front open end and comprises, a slug having a circular largest diameter portion coaxial to the axis of the slug, and at least one cylindroid portion behind the largest diameter portion, the radius thereof from the axis of the slug decreasing toward the rearward direction of the shotshell; a sleeve-like spacer is incorporated which is made of a plurality of split spacer elements which define a sleeve surrounding the slug in a direction coaxial to the slug when the spacer and slug are inserted in the case. The spacer is provided, on its inner surface, with portions which come into close contact with the cylindroid portion of the slug; and, a disc-like stabilizer, between the wad and the slug, connected to the slug by means of male and female connectors, and having a front surface which comes into close contact with the rear end of the spacer.

DESCRIPTION OF THE PREFERRED EMBODIMENTS

The present invention will be described below in detail with reference to the drawings.

Figure 1:
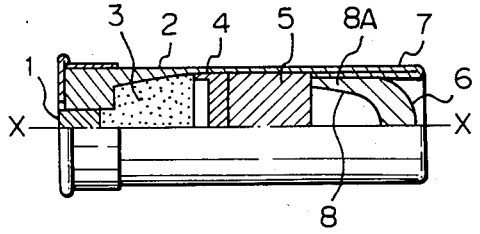
FIG. 1 is a longitudinal sectional view of a known shotgun shell.
Figure 2:
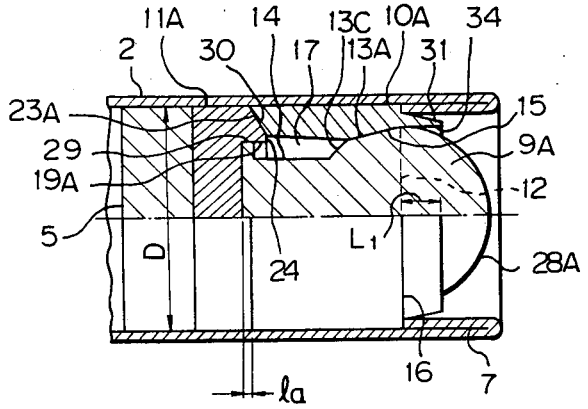
FIG. 2 is a longitudinal sectional view of a slug assembly inserted in a case, according to the present invention.
Figure 3:
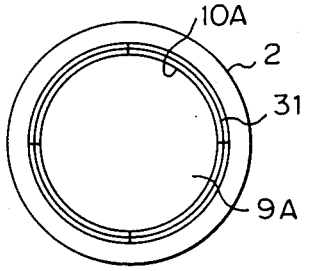
FIG. 3 is a right end view of FIG. 2.

FIG. 1 shows a known slug loaded shotshell for a shotgun. In FIG. 1, the shotshell comprises a case 2 having a primer 1. A powder 3, an over-powder wad 4, a wad 5, and a slug 6 are inserted in the case 2 in this order. The assembly in case 2 is held by a crimp 7 provided in a front open end of the case 2 and curled inward. The slug 6 has a recessed hollow portion 8 at the rear end thereof defining a hollowed cylinder 8A, so that the slug has a heavier front head which contributes to a stable flight thereof. This hollowed cylinder 8A causes a buckling of the slug during an extremely rapid acceleration occurring when fired from a gun, as mentioned before. This buckling causes an asymmetrical deformation of the slug with respect to the axis X—X of the slug. In addition, if the slug is inclined with respect to the axis X—X, when leaving the muzzle of a gun (not shown), the posture of the slug cannot be restored. In order to solve these problems of the prior art, according to the present invention, an improved slug assembly is provided as shown in FIGS. 2 to 12. In FIG. 2, the slug assembly is inserted in the case 2, having the primer 1, adjacent to the wad 5, as in the arrangement of FIG. 1. The powder 3 and the over-powder wad 4 are not illustrated in FIG. 2, but are provided in the same way as for the arrangement shown in FIG. 1. The case 2 has an inner diameter D substantially equal to the inner diameter of a desired gauge of a barrel bore of a shotgun to be used. The over-powder wad 4 is optional, and accordingly, can be omitted. A plurality of identical or different wads also can be provided in the case; this is well known and is a so-called filler wad.

The slug assembly of the present invention comprises a slug 9A, a spacer 10A, and a stabilizer llA.

Figure 4:
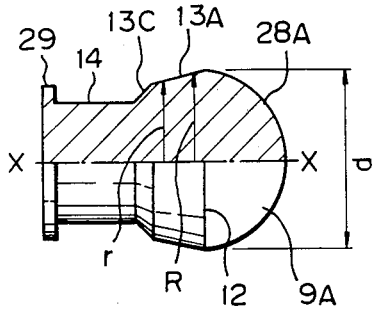
FIG. 4 is a partially sectioned side elevational view of the slug shown in FIG. 2.
Figure 5:
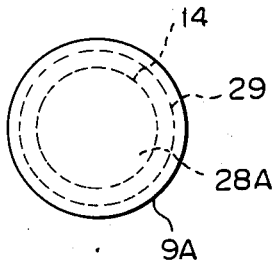
FIG. 5 is a right end view of FIG. 4.

The slug 9A shown in FIGS. 4 and 5 is made of metal or a metal alloy, such as zinc or zinc alloy, having predetermined properties agreeing with the purpose of use, including density, hardness, tensile strength, etc. The slug 9A has a circular largest diameter portion 12, the diameter of which is designated by d, two continuous conical frustum portions 13A and 13C having generatrices with different angles of inclination, and a cylindrical tail portion 14. The first conical frustum portion 13A, which forms a cylindroid portion, is connected to the largest diameter portion 12, and the second conical frustum portion 13C is connected to the rear end of the first conical frustum portion 13A. The tail portion 14 is connected to the rear end of the second conical frustum portion 13C and has an enlarged flange 29 integral therewith at the rear end of the tail portion 14. At the front end of the slug 9A is a generally semispherical head 28A connected to the largest diameter portion 12. The head 28A, the largest diameter portion 12, the two conical frustum portions 13A, 13C, the tail portion 14, and the flange 29 are coaxial to the axis X—X of the slug 9A.

Figure 6:
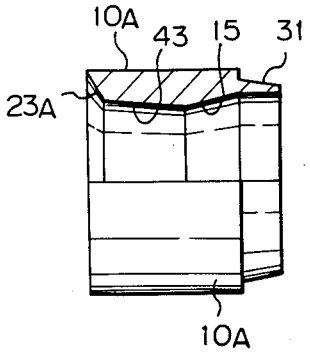
FIG. 6 is a partially sectioned side elevational view of a spacer shown in FIG. 2.
Figure 7:
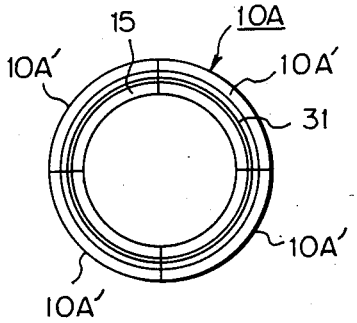
FIG. 7 is a right end view of FIG. 6.

The spacer 10A which surrounds the slug 9A is made of a flexible material, such as plastic or the like. The spacer 10A is composed of split spacer elements 10A' which form an annular sleeve surrounding the slug 9A, as shown in FIGS. 6 and 7. In the illustrated embodiment, the spacer 10A is made of four identical spacer elements 10A' which are divided at an equiangular distance of 90°. The spacer 10A has at its front end a guide 31 having a tapered outer surface which projects forward from the largest diameter portion 12 of the slug 9A when the slug 9A is assembled in the spacer 10A and which is adapted to assist in forming a uniformly curled front end of the crimp 7 and to prevent the case 2 from being cracked or cut at the curled end of the crimp 7 when the crimp 7 is released by the fired slug assembly.

The spacer 10A is provided, on its front inner surface, with a conical frustum surface 15 which comes into close contact with the first conical frustum portion 13A of the slug 9A. The spacer 10A has an inner surface 43 which is connected to the conical frustum surface 15 and which defines a space 17 surrounding the tail portion 14 of the slug 9A and the second conical frustum portion 13C. The spacer 10A has a conical frustum rear end 23A. When the slug 9A is surrounded by the spacer 10A, the rear end face of the slug 9A, i.e., the rear end face of the flange 29, is located rearward of the rear end of the spacer 10A, i.e., from the rear end edge of the rear end 23a of the spacer 10A, by a distance $l_a$ (FIG. 2).

This distance is represented by $l_b$ in another embodiment shown in FIG. 12, as will be discussed hereinafter.

Figure 8:
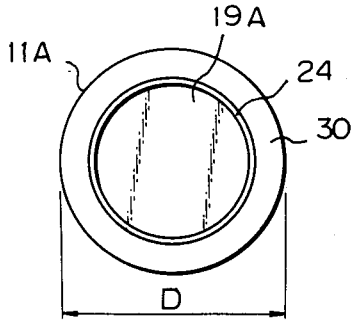
FIG. 8 is a right end view of a stabilizer shown in FIG. 2.

The stabilizer llA, which is located between the wad 5 and the slug 9A, is made of a generally disc-like plate of a flexible material, such as plastic or the like, as shown in FIGS. 2 and 8. The outer diameter D of the stabilizer llA is substantially equal to the inner diameter of the case 2. The stabilizer llA has an end face 24 and a conical frustum surface portion 30 connected to the end face 24, so that the conical frustum portion 30 comes into close contact with the rear end 23A of the spacer 10A. The stabilizer llA also has a recess 19A in which the flange 29 of the slug 9A is press-fitted so as to immovably hold the slug 9A to the stabilizer llA. Since the slug 9A is immovably connected to the stabilizer llA, which bears against the spacer 10A which, in turn, is held by the crimp 7 at the base portion of the projection (guide) 31 of the spacer 10A, the slug 9A loaded in the case cannot accidentally move or come out from the case 2.

Figure 9:
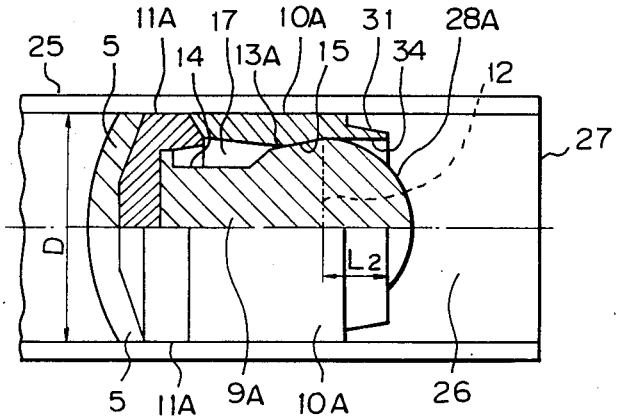
FIG. 9 is a view similar to FIG. 2, but shown in a position in which the slug assembly is forced into a barrel bore after explosion of a powder and the wad and the stabilizer are deformed by the explosion.

FIG. 9 shows a position in which the wad 5, the stabilizer llA, the spacer 10A, and the slug 9A pass through a bore 26 of a barrel 25 (which has no choke) after the curled crimp 7 is released by the explosion of the powder 3 (FIG. 1).

Since the slug 9A is relatively heavy in weight, a large inertia resistance is produced to accelerate the heavy slug 9A. On the other hand, the flexible wad 5 is compressed by the explosive pressure and is deformed, so that the thickness of the wad is decreased, as shown in FIG. 9. Since the stabilizer llA is also flexible, it also is deformed and is curved, as shown in FIG. 9.

The deformation of the stabilizer llA causes the light spacer llA, which has a small inertia resistance, to move forward.

When the spacer 10A is subject to pressure by the deformed stabilizer llA, the spacer 10A is expanded outward, since the spacer 10A comes into close contact with the slug 9A at their conical frustum surface connections 13A and 15. The outward expansion of the spacer 10A causes it to come into press contact with the inner surface of the barrel bore 26. Namely, the distance between the front end face of the projection 31 of the spacer 10A and the largest diameter portion 12 of the slug 9A changes from $L_1$ shown in FIG. 2, in which the explosion has not taken place, to $L_2$ shown in FIG. 9 in which the explosion has taken place. The difference ($L_2-L_1$) between $L_1$ (before explosion) and $L_2$ (after explosion) represents the displacement of the spacer 10A by the explosion.

As can be understood from the above discussion, since the spacer 10A moves forward in the barrel bore while in slidable and press contact with the inner surface of the barrel bore 26, and since the stabilizer llA which is connected to the slug 9A has an outer diameter substantially identical to the inner diameter of the barrel bore 26, both the spacer 10A and the slug 9A are held by the stabilizer llA and do not oscillate during the passage thereof through the barrel bore 26, and accordingly, their posture is substantially completely coaxial to the barrel bore 26 when they leave the muzzle 27. This improves the grouping or hit accuracy.

The propelling force necessary for advancing and accelerating the slug 9A acts on the end face of the flange 29 of the slug 9A. A part of the propelling force for advancing the spacer 10A is transmitted to the first conical frustum portion 13A of the slug 9A from the corresponding conical frustum surface portion 15. Thus, the propelling force for accelerating the slug 9A is divided into two main portions, and accordingly, the possibility of deformation of the slug by buckling is decreased. In addition, the slug 9A is surrounded by the spacer 10A, and accordingly, the slug does not come into direct contact with the inner surface of the barrel bore 26. Accordingly, even if the slug 9A is made of a hard material, such as hard metal, there is no possibility that the inner surface of the barrel bore 26 will be scratched by the hard slug 9A. This enables the slug 9A to be made of a material having a high tensile strength, eliminating the buckling deformation of the slug 9A.

When the slug 9A, which is connected to the stabilizer 11A, is fired from the muzzle 27 of the barrel 25 together with the spacer 10A, a high velocity air flow acts on the front surface of the semi-spherical head 28A of the slug 9A, and consequently, a stagnation point is produced and the head 28A is subject to a high pressure. On the other hand, a high speed air flow acts on the outer surface of the spacer 10A, and accordingly, the pressure in the vicinity of the outer surface of the spacer 10A is low. The inner surface 34 of the spacer 10A, which projects from the largest diameter portion 12 of the slug 9A by the length $L_2$, is subject to a larger pressure. Due to the pressure difference between the vicinity of the front end of the slug 9A and the outer surface portion of the spacer 10A, the four spacer elements 10A' expand outward as soon as the slug assembly leaves the muzzle 27 of the gun. As a result, the spacer elements 10A' separate from the slug 9A and the stabilizer 11A and fall away. In this way, the slug 9A can fly along the firing axial line 0—0 (FIG. 10) together with the stabilizer 11A without being interrupted by the spacer 10A. In this sense, it will be understood that the number of the spacer elements 10A' is not limited to four but can be two or three or more than four.

Figure 10:
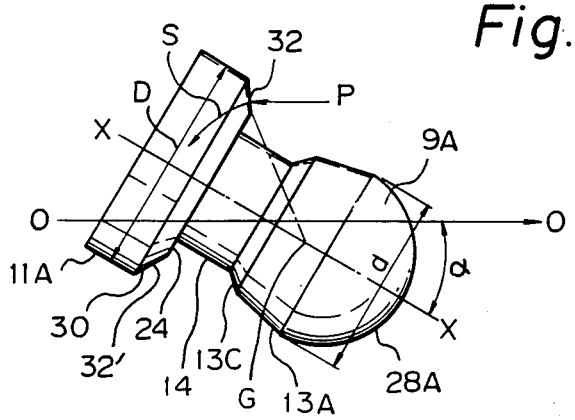
FIG. 10 shows a slug which is inclined with respect to the axis.

Since the diameter D of the stabilizer 11A is larger than the largest diameter d of the slug 9A, i.e., the diameter of the largest diameter portion 12 of the slug 9A, the air current flowing on and along the outer periphery of the slug 9A gives a uniform aerodynamic force to the front end face 24 and the inclined front surface 30 of the stabilizer 11A. This ensures a balanced form drag. However, if the slug 9A is inclined with respect to the firing axis 0—0 by the angle $\alpha$, for some reason, as shown in FIG. 10, the form drag becomes unbalanced, for example, between a point 32 on the conical frustum surface portion 30 and a point 32' located in a symmetrical arrangement to the point 32. This unbalanced form drag produces a restoring moment having a moment arm of a line (32-G) extending between the point 32 and the center of gravity G of the slug 9A, in the direction designated by an arrow S.

Due to this restoring moment, the assembly of the slug 9A and the stabilizer 11A is easily restored to its original posture in which the axis X—X of the slug 9A is consistent with the firing axis 0—0. Note, the inclination of the slug 9A is exaggerated in FIG. 10. Even when the inclination angle $\alpha$ is very small, the restoration can be quickly effected. Namely, the slug 9A of the present invention can well follow the change of posture thereof. Therefore, the slug 9A of the present invention does not wobble, i.e., repeatedly pitching and yawing, a motion well known as a "Dutch roll" in aeronautics.

As can be understood from the foregoing, according to the present invention, the slug assembly passes through the barrel without deforming or oscillating and leaves the barrel in the correct posture, in which the slug axis is identical to, i.e., coaxial to, the barrel axis. This improves the hit accuracy, i.e., the grouping of the projectiles (slugs). Furthermore, according to the present invention, since the slug is surrounded by the spacer, the possibility of the metal of which the slug is made adhering to and coating the inner surface of the barrel bore is eliminated. In addition, when the slug assembly is fired from the barrel, the spacer is expanded and moves in the barrel bore while coming into close contact with the inner surface of the barrel bore as mentioned above. This expansion of the spacer elements allows an automatic fit of the slug assembly of the invention to the barrels of any gun having the same gauge. Namely, the slug assembly of the present invention can absorb any slight difference in dimension between the barrels of guns having the same gauge.

The diameter of the slug 9A is smaller than the inner diameter of the barrel bore by a length corresponding to the thickness of the spacer. The slug can be made of metal having a small density to realize a light slug load, so that even when the slug is fired at a high muzzle velocity, a reduced recoil can be expected.

The slug assembly can be advantageously used in a true cylinder (or plane cylinder) or improved cylinder barrel. However, it is very important to make the slug assembly of the present invention applicable to a full choke barrel without causing expansion and fatigue rupture of the full choke barrel, ensuring safe shooting.

The space 17 between the slug and the spacer, mentioned above, contributes not only to the provision of a light spacer but also to an easy passage of the slug assembly through the full choke barrel portion without expanding the latter. Namely, since the spacer 10A and the stabilizer 11A have a diameter larger than the inner diameter of the barrel bore of the full choke portion, the velocity of the spacer 10A and the stabilizer 11A is rapidly reduced when they pass through the full choke portion because of a high resistance to the movement of the spacer 10A and the stabilizer 11A by the full choke portion. However, in the present invention, since the slug which has a diameter smaller than the diameter of the full choke barrel portion is heavy and has a large kinetic energy at a high speed, the connection between the slug and the stabilizer is broken due to the inertia force, so that the slug separates from and moves ahead of the spacer and passes alone through the full choke barrel portion. At this time of separation of the slug from the spacer, since the outer diameter of the flange 29 of the slug 9A is smaller than the outer diameter of the space 17 (i.e., the inner diameter of the spacer 10A), there in no bar against the movement or separation of the slug from the spacer. It should be appreciated that the barrel is not damaged when the spacer 10A and the stabilizer 11A pass therethrough after the slug passes, since the spacer and stabilizer are flexible, and accordingly, can easily deform.

Figure 11:
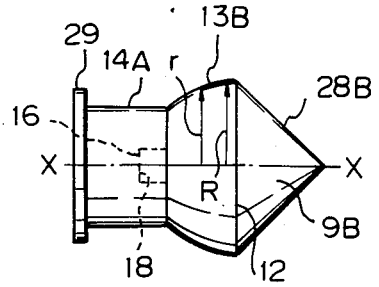
FIG. 11 is a side elevational view of a different slug according to the present invention; and, FIG. 12 is a partially sectioned side elevational view of a slug assembly according to another embodiment of the present invention.

In a modified embodiment shown in FIG. 11, the slug 9B has a conical head 28B and a cylindroid portion 13B integral with the conical head and having a rotational outer surface with arc generatrices. The cylindroid portion 13B has a pin projection 16 at its rear end. The slug 9B also has a tail portion 14A with a flange 29. The tail 14A is provided, on its front end, with a center recess 18 in which the pin projection 16 of the cylindroid portion 13B can be press fitted, so that the tail 14A is secured to the cylindroid portion 13B. In order to locate the center of gravity of the slug 9B as close as to the front end thereof, the head 28B and the cylindroid portion 13B are preferably made of a metal having a heavy density, such as lead, whereas the tail 14A is preferably made of light metal or plastic material, having a small rigidity and small density.

A spacer which is to be used with the modified slug 9B is similar to that used with the slug 9A shown in FIG. 6, except that the shape of the inner surface of the spacer coming into contact with the rotationary surface 13B of the slug 9B is at least partially complemental to the shape of the surface 13B consisting of arc generatrices. The operation of the slug assembly having the slug 9B is same as that of the slug assembly having the slug 9A.

Figure 12:
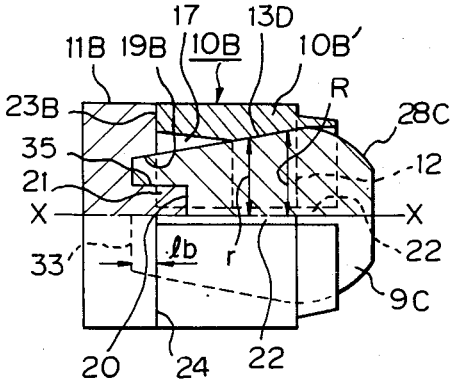

FIG. 12 shows still another modification of a slug. The slug 9C shown in FIG. 12 has a semispherical frustum head 28c and a conical frustum cylindroid portion 13D which is integrally connected to the rear end of the head 28. The slug 9C does not have a tail corresponding to the tail 14 or 14A. The cylindroid portion 13D has at its rear end face 33 a center recess 20. The stabilizer llB which is to be used with the slug 9C has a flat front end face 24 which is provided with a center projection 21 and an annular recess 19B coaxially surrounding the projection 21. The projection 21 is fitted into the recess 20 of the slug 9C, and the rear end of the slug 9C is fitted into the recess 19B of the stabilizer llB. The connection between the stabilizer llB and the slug 9C can be effected, for example, by means of a bonding adhesive 35 or other adhesive provided between the projection 21 and the recess 20.

The spacer 10B shown in FIG. 12 is composed of two spacer elements 10B' which are opposed to each other with gaps 22 therebetween. Namely, between the opposing end faces of the two spacer elements 10B' are provided with gaps 22, unlike the arrangement shown in FIG. 7, in which the four spacer elements are continuously connected to each other to define a complete circle without gaps therebetween. The spacer 10B has a flat rear end face 23B which comes into close contact with the flat surface 24 of the stabilizer llB.

In the embodiments mentioned above, the connection between the slug and the stabilizer can be also performed by thread or screw, besides friction by press fitting (FIG. 2), or by a bonding adhesive or the like (FIG. 12).

The cylindroid portion 13 (13A in FIG. 4, 13B in FIG. 11, and 13D in FIG. 12) has a rotational inclined surface consisting of straight or curved generatrices. Namely, the cylindroid portion 13 can be made by rotating an inclined curved or straight generatrix about an axis by one turn, so that the distance between the axis X—X from the outer surface profile of the cylindroid portion decreases in the rearward direction from R to r, as shown in FIGS. 4, 11 and 12.

I claim:

1. A slug assembly for a shotgun shotshell having a case with a primer, a powder in the case, and at least one wad in the case adjacent to the slug assembly, said case being crimped at its front open end, said slug assembly comprising:

a slug having a circular largest diameter portion coaxial to the axis of the slug, and at least one cylindroid portion at the rear of the largest diameter portion having a radius from the axis of the slug decreasing toward the rearward direction of the shotshell;

a spacer which is made of a plurality of split spacer elements so as to define a sleeve surrounding the slug in a direction coaxial to the slug when the spacer surrounding the slug is inserted in the case, each of said spacer elements defining a space surrounding the slug, said spacer being provided, on its inner surface, with portions which come into close contact with the cylindroid portion of the slug; and a stabilizer having a disc body between the wad and the slug, secured to the slug by means of male and female connectors, said stabilizer having a front surface which comes into close contact with the rear end of the spacer, said stabilizer having a diameter larger than said largest diameter portion of the slug.

2. A slug assembly according to claim 1, wherein said spacer elements are spaced from one another around the slug at a predetermined gap.

3. A slug assembly according to claim 1, wherein said slug is made of a plurality of elements.

4. A slug assembly according to claim 3, wherein the plurality of elements of the slug are made of different materials.

* * * * *